United States Patent [19]

Taylor et al.

[11] Patent Number: 4,693,289

[45] Date of Patent: Sep. 15, 1987

[54] WHEELCHAIR COVER AND METHOD OF USING SAME

[75] Inventors: Cynthia L. Taylor; Judith E. M. Nash, both of Orleans, Mass.

[73] Assignee: Community of Jesus, Inc., Orleans, Mass.

[21] Appl. No.: 769,160

[22] Filed: Aug. 23, 1985

[51] Int. Cl.[4] ..... B65D 65/02

[52] U.S. Cl. ..... 150/52 R; 190/903; 206/335; 224/42.03 R; 280/202; 280/289 WC; 414/462

[58] Field of Search ..... 280/242 WC, 289 WC, 280/202, 203; 296/136; 52/19; 224/42.03 R, 42.03 B, 42.07; 150/52 R, 52 F, 52 K, 52 E; 206/326, 335; 53/428; 190/903; 217/37, 38; 414/462; 297/188, 191

[56] References Cited

U.S. PATENT DOCUMENTS

| | | | |
|---|---|---|---|
| 542,096 | 7/1895 | Mumford | 217/37 |
| 2,311,514 | 2/1943 | Bramblett | 150/52 K |
| 2,436,369 | 2/1948 | Allen | 190/903 X |
| 3,734,272 | 5/1973 | Galen | 217/37 X |
| 3,820,651 | 6/1974 | Levy | 206/390 |
| 3,878,955 | 4/1975 | Udden | 414/462 |
| 3,968,913 | 7/1976 | Weed et al. | 224/42.03 B |
| 4,126,213 | 11/1978 | McDonald | 190/903 X |
| 4,143,694 | 3/1979 | Gregory | 206/315.1 |
| 4,244,411 | 1/1981 | Karlstrom et al. | 150/52 F |
| 4,376,611 | 3/1983 | Koop | 414/462 |
| 4,390,088 | 6/1983 | Brenner | 206/335 |
| 4,437,599 | 3/1984 | Jordening | 280/289 WC |

FOREIGN PATENT DOCUMENTS

| | | | |
|---|---|---|---|
| 2437323 | 5/1980 | France | 224/42.03 B |

*Primary Examiner*—Stephen Marcus
*Assistant Examiner*—Bryon Gehman
*Attorney, Agent, or Firm*—Gregor N. Neff

[57] ABSTRACT

A protective wheelchair cover into which a wheelchair is easily introduced, and methods of using same during the transportation or storage of a wheelchair. The cover provides a complete enclosure into which a wheelchair can be easily rolled. The cover provides protection during the transportation of a wheelchair by motor vehicle, or during storage of a wheelchair.

3 Claims, 5 Drawing Figures

WHEELCHAIR COVER AND METHOD OF USING SAME

FIELD OF THE INVENTION

The field of this invention is a wheelchair cover, and in a more specific vein, a protective wheelchair cover into which a wheelchair is easily introduced. Such a wheelchair cover may be used, for example, during the transportation of a wheelchair by motor vehicle or during the storage of a wheelchair.

BACKGROUND OF THE INVENTION

The use of wheelchairs by disabled or elderly persons is widespread and is likely to increase due to the advances in medicine which have contributed to a prolonged life expectancy and a general aging of the population. Consequently, there is an increasing need for aids such as wheelchairs.

A wheelchair is a relatively expensive device and a rather delicate item which has numerous moving parts. It is therefore desirable to protect a wheelchair during transportation or storage.

It is frequently the case that the transportation of a wheelchair by motor vehicle is desired. In the past, when transportation of a wheelchair by motor vehicle was undertaken, in order to protect the wheelchair from the elements, it was usually required that a wheelchair be placed inside the vehicle. This meant that the transportation of wheelchairs was limited to vehicles large enough to accommodate a wheelchair, and that less room was available in the vehicle for passengers. Placement inside the vehicle also meant that the wheelchair had to be lifted into the interior of said van or other vehicle. Since wheelchairs are relatively heavy devices, such lifting is difficult if not impossible for a disabled person, as well as being difficult for even an able-bodied person involved in the transportation of a wheelchair. Thus, the technique for transporting a wheelchair in.the interior of a vehicle has been found to be unsatisfactory.

Another technique used in the past for transportation of a wheelchair involved placement of a wheelchair onto a roof rack on top of the motor vehicle where the wheelchair was exposed to the elements. Such exposure is most undesirable.

One object of the invention is to provide a cover. When providing a cover to entirely enclose a wheelchair and protect it from the elements, special problems arise. One such problem arises in placing the cover on the wheelchair. Placing such a cover on a wheelchair normally would require one to lift the wheelchair -- a difficult task for the infirm, and an arduous task for those assisting the infirm. Other special problems arise in providing a weatherproof cover which can be attached easily and securely to the outside structures of vehicles, such as to the luggage and bicycle racks ordinarily attached to motor vehicles.

OBJECTS OF THE INVENTION

It is the object of the present invention to overcome or alleviate the foregoing problems, and provide a wheelchair cover and method which are well-suited for the protection of a wheelchair during the transportation of a wheelchair by motor vehicle.

It is another object of the invention to provide a wheelchair cover which protects the wheelchair during storage.

It is a further object of the invention to provide a wheelchair cover in which a wheelchair can be placed and then attached on to the back of a motor vehicle for transportation.

It is still another object of this invention to provide a wheelchair cover which allows for the protection of a wheelchair during transportation, in which the wheelchair need not be taken inside the vehicle.

It is yet another object of this invention to provide a wheelchair cover into which the folded wheelchair can be easily introduced—preferably, without lifting the wheelchair.

It is a further object of this invention to provide a wheelchair cover which facilitates mounting the enclosed wheelchair onto a rack attached to a motor vehicle.

These and other objects are met by the present invention.

BRIEF DESCRIPTION OF THE INVENTION

The present invention is directed, inter alia, to a wheelchair cover (as an article of manufacture) suitable for use in the protection of a wheelchair, which comprises an enclosure having four side walls, one top wall and a floor. One side wall can be laid on a flat surface and a wheelchair can be rolled on that wall into the enclosure without lifting the wheelchair.

In another aspect, the present invention is directed to a wheelchair cover (as an article of manufacture) suitable for use in the protection of a wheelchair. The cover comprises a protective enclosure having a bottom section and a top section. The bottom section of the enclosure has four side walls and a floor, one side wall being a flap, detachable from and reattachable to the bottom section. This flap allows, when detached, a wheelchair to be rolled into the bottom section onto the floor of the bottom section. The bottom section is of a size and shape to enclose protectively the lower portion of the wheelchair when said flap is reattached. The top section of the enclosure has four side walls and one top wall, and the top section is of a size and shape to enclose protectively the upper portion of a wheelchair which has its lower portion enclosed by the bottom section of the enclosure. The upper section of the enclosure contacts the bottom section of the enclosure, thereby forming a protective enclosure for a wheelchair.

In another aspect, the invention is directed to a method of transporting a wheelchair by motor vehicle which comprises introducing the folded wheelchair into an enclosure having four side walls, one top wall and a floor. One side wall is a flap, which is on three edges detachable from, and reattachable to, the enclosure. The flap allows, when detached, a wheelchair to be rolled into the enclosure onto the floor of the enclosure. The protective enclosure may be constructed of a rigid material, such as molded plastic, and then attached to a motor vehicle for example, by means of strapping it to a rack.

In a further aspect, the invention is directed to a means of transporting a wheelchair by motor vehicle, which comprises introducing a folded wheelchair into a protective enclosure having a bottom section and a top section. The bottom section of the enclosure has four side walls and a floor. One side wall is a flap, detachable from and reattachable to the bottom section. The flap allows, when detached, a wheelchair to be rolled into the bottom section onto the floor of the bottom section. The bottom section is of a size and shape to enclose protectively the lower portion of the wheelchair when said flap is reattached. The top section of the enclosure has four side walls and one top wall, and the top section is of a size and shape to enclose protectively the upper portion of a wheelchair which has its lower portion enclosed by the bottom section of the enclosure. The top section of the enclosure contacts the bottom section of the enclosure, thereby forming a protective enclosure for a wheelchair.

Numerous advantages occur with the practice of the present invention. It has now been discovered that a means of protecting a wheelchair during transportation by motor vehicle exists, which means avoids the introduction of the wheelchair into the interior of the motor vehicle. The inventive cover also provides an enclosure into which a wheelchair may be rolled with ease, without lifting the wheelchair. The above-described wheelchair cover eliminates the need for a large motor vehicle when transporting a wheelchair is desired and in one embodiment provides a means for avoiding lifting a wheelchair onto a roof rack.

The invention furthermore provides a protective enclosure into which a wheelchair can be rolled with ease for purposes of storage.

DESCRIPTION OF CERTAIN PREFERRED EMBODIMENTS

The provision of a wheelchair cover which allows for the ready transportation of a wheelchair on the back of a motor vehicle is dependent upon the construction of the protective cover. The protective cover should be capable of protecting the wheelchair from the elements while also allowing for placement of the covered wheelchair onto a rack on the exterior of a motor vehicle.

Figure 1:
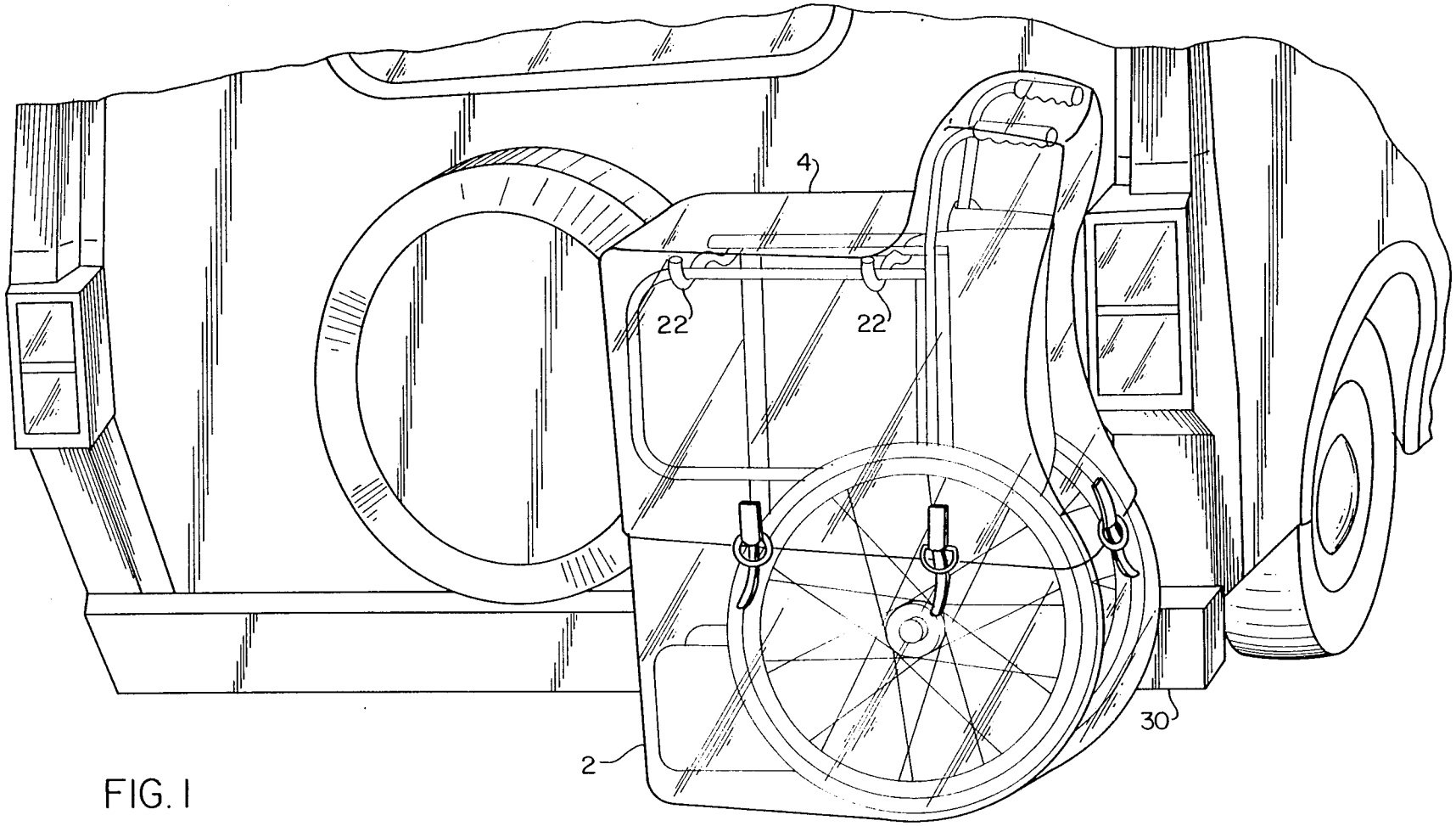
FIG. 1 is a perspective view of one embodiment of the wheelchair cover showing it in use and attached to a rack on a vehicle.
Figure 2:
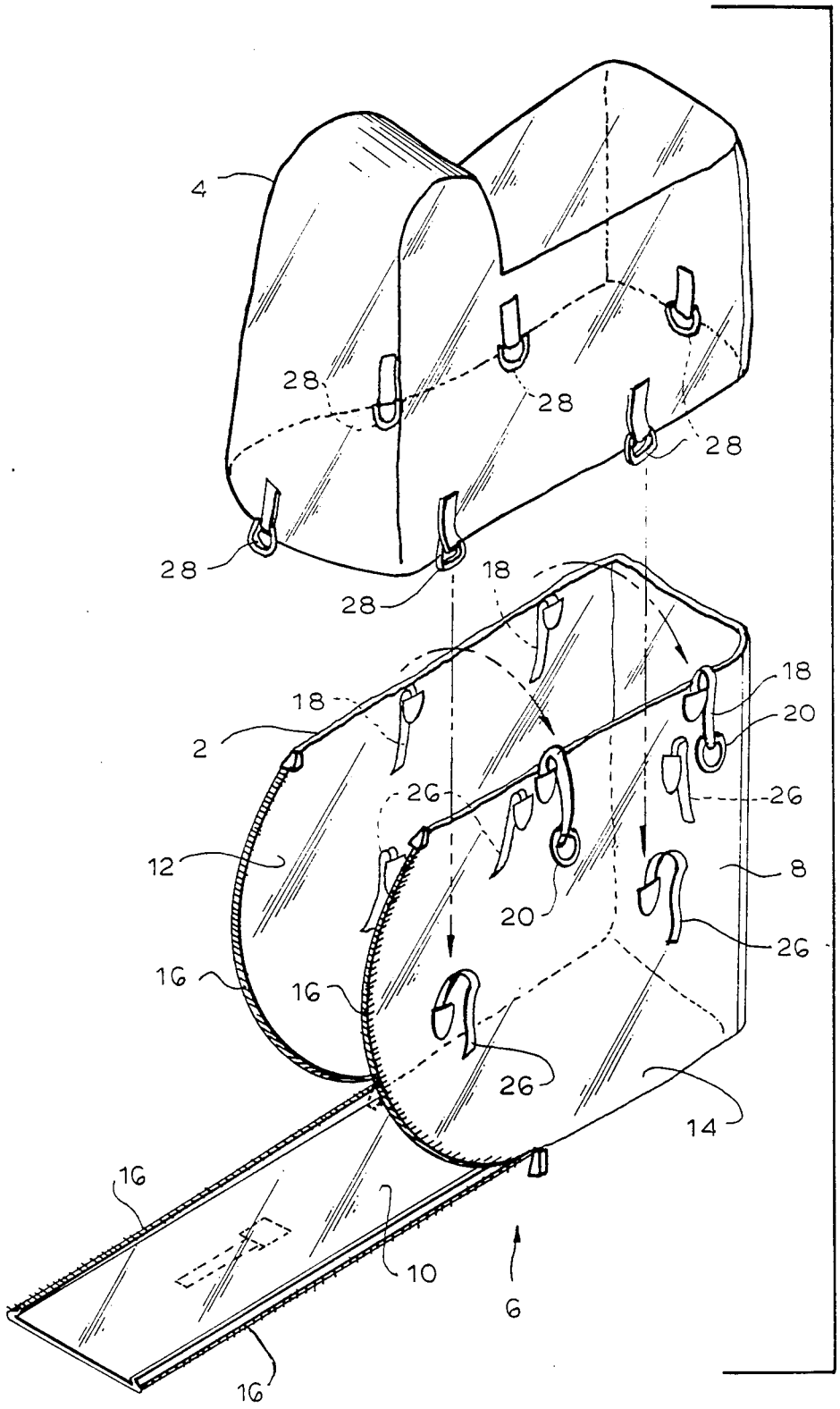
FIG. 2 is an exploded perspective view of the embodiment of the wheelchair cover shown in FIG. 1.
Figure 3:
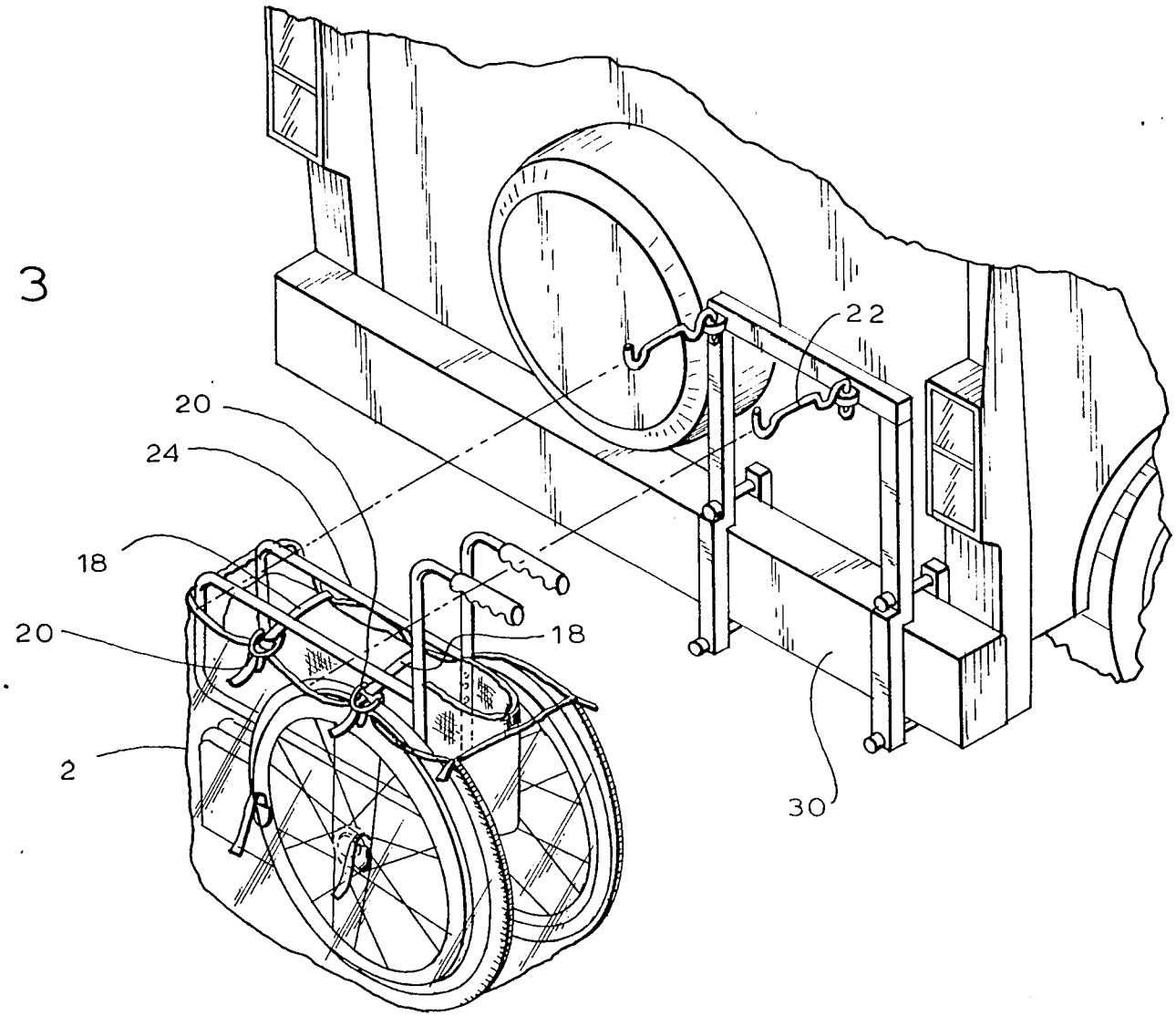
FIG. 3 is an exploded perspective view of the embodiment of the wheelchair cover shown in FIG. 1 in the process of being placed onto a rack on a vehicle.

In one embodiment of the invention depicted in FIGS. 1, 2, and 3, a two-part protective enclosure is utilized. In this embodiment, the enclosure has a bottom section 2 and a top section 4. The bottom section 2 has four side walls 6, 8, 10, 12 and a floor 14, one side wall 10 being constructed as a detachable flap permitting the rolling of a folded wheelchair onto the floor 14 of the bottom section 2 of the enclosure.

After the wheelchair is rolled onto the floor 14, the side wall flap 10 can be joined to the bottom section of the enclosure by fastening means 16, such as a zipper which is placed along the vertical edges of the side wall flap. The flap can be closed after the wheelchair is rolled onto the floor. At this point, as shown in FIG. 3, the wheelchair is only partially covered, i.e. the upper portion of the chair is still exposed. The bottom section of the enclosure may be secured onto the chair by means of straps 18 which fasten to D-rings 20 across the chair. The chair can then be hung onto a rack 22 by means of the chair arms 24. The top section 4 of the enclosure is then lowered over the exposed portion of the wheelchair and attached to the bottom section 2 of the enclosure by fastening means, for example, straps 26 and D-rings 28.

In accordance with this embodiment of the invention, the two-part enclosure of the cover, preferably, is made of naugahyde or other suitable heavy-duty protective material. Alternatively, it can be a rigid, molded thermoplastic case.

The bottom portion of the enclosure 2 has a side wall flap 10 which is opened and closed by means of a pair of zippers 16 on each vertical edge of the flap. Both zippers 16 may be opened as shown in FIG. 2 and the wheelchair rolled directly onto the floor 14 of the bottom portion of enclosure. Next, the zippers 11 may be closed. The bottom portion of the enclosure 2 may be secured onto the chair by cinching straps 18. These straps may be run across the wheelchair and affixed to D-rings 20 located on the exterior of the bottom portion of the enclosure. The chair may be placed on rack 22 located on the rear bumper 30 (FIGS. 1 and 3) of a motor vehicle such as a van. The chair is hung on the rack by means of the chair arms 24. The top section 4 of the protective enclosure may be placed over the uncovered upper part of the chair and fastened securely to the bottom portion 2 of the enclosure. This may be done by means of straps 26 are secured to D-rings 28. If desired, for greater security, straps may be run from the rack 22 over and around the covered chair, and back onto the rack 22. For example, two shock straps may be utilized in a cross style around the enclosed chair.

While this protective cover is especially useful in the transportation of a wheelchair by motor vehicle, it can be readily seen by those of ordinary skill in the art that such a wheelchair cover will be useful for the protection of a wheelchair during storage. The ease of introduction of the wheelchair into the cover provided by the instant invention, is most advantageous, particularly for a disabled individual.

Figure 4:
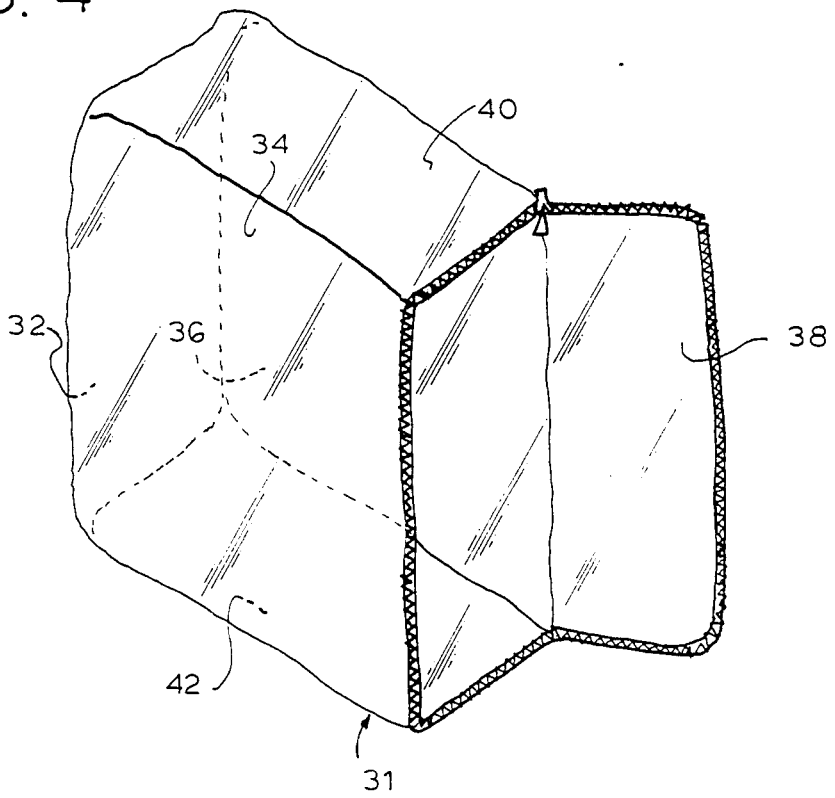
FIG. 4 is a perspective view of another embodiment of the wheelchair cover.
Figure 5:
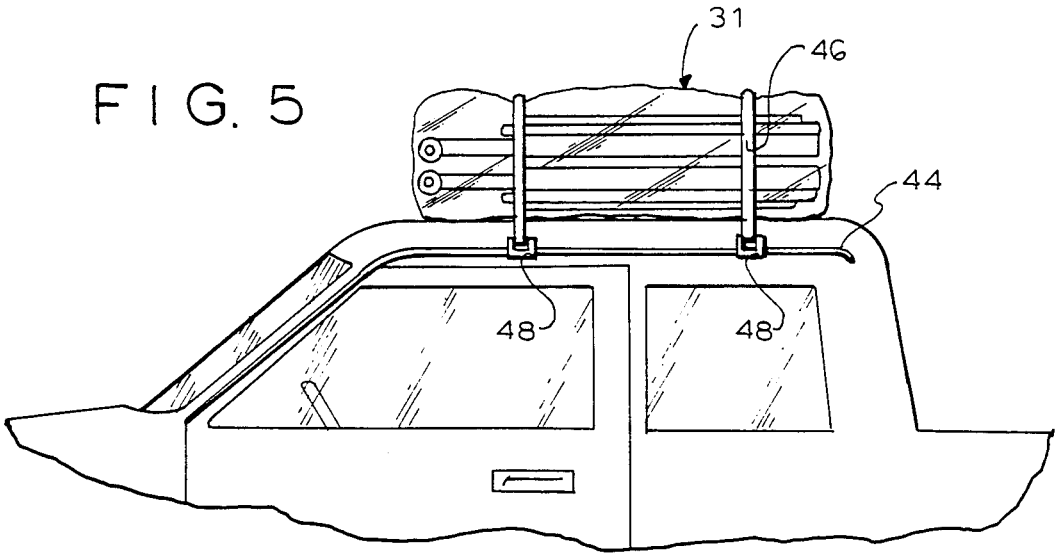
FIG. 5 is a side elevation view of the embodiment of the wheelchair cover shown in FIG. 4, showing it in use and attached on the roof of a vehicle.

In another embodiment, as shown in FIG. 4, the enclosure 31 has four side walls 32, 34, 36, 38, top wall 40 and a floor 42. One side wall 38 is a flap which is detachable from and reattachable on three edges to the enclosure 31. When flap 38 is detached, a wheelchair may be rolled directly into the enclosure 31. The wheelchair, so protected, may then be placed on the roof of an automobile as depicted in FIG. 5, and secured by straps 46 and conventional clips 44 which engage the guttering 44 or other structure on the automobile. Alternatively, a standard roof rack for automobiles can be used to hold the covered wheelchair onto the roof of the automobile.

From the foregoing, it can be seen that the invention provides an effective means of protecting a wheelchair during transportation by motor vehicle, or in other situations. It is easy to use, is of simple, sturdy and economical construction, and helps to ease the life of the invalid.

The invention thus offers a reliable alternative for the transportation of a wheelchair which is superior to the use of inconvenient and expensive prior techniques which involve the need for placement of a wheelchair into the interior of a motor vehicle.

It will be appreciated that the present invention is not limited to application within the transportation field but finds ready application in various other types of wheelchair protection.

The terms and expressions which have been employed are used as terms and expressions of description and not of limitation, and there is no intention in the use of such terms and expressions of excluding any equivalence of the features shown and described or portions thereof, it being recognized that various modifications are possible within the scope of the invention.

What is claimed is:

1. A wheelchair cover comprising a flexible protector enclosure having a bottom section and a top section, the bottom section of the enclosure having four side walls and a floor, one side wall being a flap, which side wall is unitary with the floor and attached to each adjacent side wall by a discrete zipper fastener, with each zipper fastener extending only along the adjacent side walls, so as to allow, when said flap is detached, a wheelchair to be rolled into the bottom section onto the floor of the bottom section and said bottom section being of a size and shape to enclose protectively the lower portion of the wheelchair when said flap is reattached, and the top section of the enclosure having four side walls and one top wall, which top section is of a size and shape to enclose protectively the upper portion of a wheelchair which has its lower portion enclosed by the bottom section of the enclosure, the upper section of the enclosure contacting the bottom section of the enclosure, thereby forming a protective enclosure for a wheelchair.

2. A wheelchair cover as defined in claim 1, wherein top section of the enclosure comes into overlapping contact with the bottom section of the enclosure, and the top section is fastened to the bottom by fastening means.

3. A method of protecting a wheelchair which comprises placing a wheelchair into a flexible wheelchair cover which has a bottom section and a top section, the bottom section of the enclosure having four side walls and a floor, one side wall being a flap, which side wall is unitary with the floor and attached to each adjacent side wall by a discrete zipper fastener, with each zipper fastener extending only along the adjacent side walls, so as to allow, when said flap is detached, a wheelchair to be rolled into the bottom section onto the floor of the bottom section and said bottom section being of a size and shape to enclose protectively the lower portion of the wheelchair when said flap is reattached, and the top section of the enclosure having four side walls and one top wall, which top section is of a size and shape to enclose protectively the upper portion of a wheelchair which has its lower portion enclosed by the bottom section of the enclosure, the upper section of the enclosure contacting the bottom section of the enclosure, thereby forming a protective enclosure for a wheelchair.

* * * * *